United States Patent [19]

Johnson

[11] 4,260,932

[45] Apr. 7, 1981

[54] METHOD AND CIRCUIT FOR FACILITATING THE STARTING AND STEADY STATE FLICKERLESS OPERATION OF A DISCHARGE LAMP

[76] Inventor: Vance Johnson, 126 Quimby Ave., Trenton, N.J. 08610

[21] Appl. No.: 950,765

[22] Filed: Oct. 12, 1978

Related U.S. Application Data

[63] Continuation-in-part of Ser. No. 757,673, Jan. 7, 1977, abandoned.

[51] Int. Cl.[3] ..... H05B 37/00; H05B 39/00; H05B 41/14

[52] U.S. Cl. ..... 315/205; 315/229; 315/DIG. 5; 315/DIG. 7

[58] Field of Search ..... 315/DIG. 2, DIG. 3, 315/DIG. 5, DIG. 7, 205, 203, 207, 229, 265, 272, 266; 307/321, 259; 328/208

[56] References Cited

U.S. PATENT DOCUMENTS

| | | | |
|---|---|---|---|
| 3,676,735 | 7/1972 | Roche | 315/207 |
| 3,787,751 | 1/1974 | Farrow | 315/207 |
| 3,818,268 | 6/1974 | Peltz | 315/205 |
| 3,857,063 | 12/1974 | Major et al. | 315/207 |
| 3,962,591 | 6/1976 | Popka | 307/264 |

FOREIGN PATENT DOCUMENTS

| | | | |
|---|---|---|---|
| 2036795 | 1/1972 | Fed. Rep. of Germany | 315/205 |
| 2251981 | 6/1975 | France | 315/205 |

*Primary Examiner*—Saxfield Chatmon, Jr.
*Attorney, Agent, or Firm*—David A. Jackson

[57] ABSTRACT

The present application discloses a circuit for improving the efficiency of energy consumption, extending lamp life, and facilitating the starting and steady state flickerless operation of a discharge lamp normally utilizing a source of alternating current, such circuit including: (a) a full wave rectifier connected between both an input set of terminals and an output set of terminals, the input set comprising the AC line input leads and the output set comprising the positive and negative supply leads of the lamp; (b) a voltage-raising capacitance disposed between one terminal of the AC input and one or both terminals of the rectifier output; and (c) a filtering means connected between the positive and negative output of said full wave rectifier, wherein the output of the voltage-raising capacitance is applied across the filtering means, thereby providing a no-load voltage at the output leads which is approximately equal to $(2\sqrt{2})\ E_{input}$ (rms). Additionally, in order to prevent excessive charge buildup within the lamp; provide equal wear of each lamp electrode; and, to minimize migration of the phosphor coating of the lamp, a switching means is provided in order to approximately equalize the amount of time during which the lamp current flows in each direction through the lamp.

11 Claims, 18 Drawing Figures

METHOD AND CIRCUIT FOR FACILITATING THE STARTING AND STEADY STATE FLICKERLESS OPERATION OF A DISCHARGE LAMP

REFERENCE TO RELATED APPLICATION

This application is a continuation-in-part of Ser. No. 757,673, filed Jan. 7, 1977, now abandoned, entitled Method and Circuit for Facilitating the Starting and Steady State Flickerless Operation of a Discharge Lamp. The specification thereof is incorporated by reference herein.

BACKGROUND OF THE INVENTION

A long-standing problem in the technology of lighting and light-source provision has been that of creating a light source having a wave length and wave pattern compatible with the physiology of the human eye. That is, the wave length of any light source should, ideally, fall within that range within which the eye can most easily focus. Further, the amplitude of such a light source should be as constant as possible, in order to conform with the characteristic of natural daylight (which exhibits an essentially constant amplitude).

More particularly, since the human eye has evolved in an environment of light which is predominantly in the yellow-green area of the spectrum (500 to 650 nanometers), the cones of the retina are thusly most sensitive to light within said range. There are, of course, three types of cones within the retina which respond to the following frequencies, e.g., 430 nanometers for purple; 535 nanometers for green; and 575 nanometers for orange. However, an ideal artificial light source should provide light having its greatest concentration of frequencies within the yellow-green area.

The above guidelines for an ideal artificial light source have, in the prior art, not been fully attained. More particularly, the prior art incandescent lamp, generally known as the Edison lamp, has differed from the ideal in at least three areas, namely, in that its emitted radiation contains a predominance of wave lengths in the red end of the spectrum within which the human eye does not focus properly, due to its inherent chromatic aberration; it exhibits an amplitude change of either 100 or 120 HZ; and, of course, there is the well-known energy-waste problem associated with such lamps.

The typical prior art discharge lamp, although more electrically efficient than the incandescent lamp, and, in the case of some lamps, emitting energy in the more desirable yellow-green region of the visual spectrum, nonetheless produces a high level periodic amplitude change of either 100 or 120 Hertz. It is to be appreciated that such a periodic amplitude change creates a "strobing" effect which, to many persons, results in the psychologically-disturbing subjective effect of objects appearing to jump from place to place, rather than appearing in smooth movement. Also, in said high level periodic amplitude situation, the eye and its associated feedback mechanism is continually attempting to compensate for the changing brightness and to refocus due to the aforementioned strobing—the result of which is chronic (technically termed tonic) contraction of the meridional fibers of the iris, the sphincter muscles of the iris, and the ciliary muscles of the lens —all of which can result in burning sensations within the eye or headaches of several types or a combination of the above, according to the sensitivity of the particular individual. Accordingly, this continual re-adjusting of the light-admitting mechanism and the focusing mechanism results in greater eye fatigue than would occur in the absence of such a high level periodic amplitude change. Thusly, it is the primary objective of the present invention to provide an input circuit for discharge lamps which will not only alleviate the change of amplitude problem associated with prior art discharge lamps, but, at the same time, provide a substantial improvement in economy of operation.

SUMMARY OF THE INVENTION

The present invention relates to a circuit for improving the efficiency of energy consumption, extending lamp life, and facilitating the starting and steady-state flickerless operation of a discharge lamp normally utilizing a source of alternating current, comprising: a full wave rectifier connected between both an input set of terminals and an output set of terminals, said input set of terminals comprising the AC line current supply and the output set of terminals comprising the positive and negative leads of the lamp; a voltage-raising capacitance disposed between one terminal of said AC input and at least one terminal of said rectifier output; and a filtering capacitor connected between the positive and negative output of said full wave rectifier, wherein the output of said voltage-raising capacitance is applied across said filtering capacitor, thereby providing a no-load voltage across said filtering capacitor approximately equal to twice the peak input line voltage.

A discharge lamp is, in essence, an elongated tube, sealed under pressure, having therein an ionizable gas which, upon exposure to a particular level of electrical energy, will undergo ionization of the contained gas so as to maintain a current flow throughout the length of the tube.

During conduction of the lamp, consisting of both ion flow and electron flow, bombardment of the ions by the electrons results in the raising of the outer-orbit electrons of the ions to higher energy levels. As the electrons of the ions fall back to the more stable lower energy levels in incremental steps (quantum-level jumps), said ions emit either ultraviolet or visible radiation according to the particular type of lamp used.

The emitted ultraviolet radiation, in the case of a flourescent lamp, then impinges on the atoms of the flourescent coating, within the lamp, the result of which is that the atoms of the fluorescent coating are "pumped" to higher energy levels (i.e., the outer-orbit electrons are raised to higher energy levels by the input of ultraviolet light energy).

The outer-orbit electrons of the flourescent coating then randomly return (fall back) to the more stable lower energy levels in incremental steps (quantum-level jumps) —the result of which is the emission of electromagnetic radiation in the form of visible light (photons). Thus, in the prior art, where an alternating current is applied across the terminals of the lamp, the result is a periodically changing current flow through the conductive gas with a resultant periodic change in the amount of light output. That is, an AC input to a discharge lamp will create continual excursions in the photon output of the lamp, with resultant physiological problems to the eye and its associated control mechanisms, as above set forth in the Background of the Invention.

Further, it is to be appreciated that the use of a unidirectional input to the lamp, as opposed to AC, will involve a significant increase in the energy efficiency of the unit. Such efficiency results from the fact that although the light output of a discharge lamp increases as a function of the power input to the lamp, said output is not a linear function of the input. Accordingly, with each incremental increase in current density, within the lamp, an increasingly smaller percentage of the gaseous current flow will result in unit photon output from the lamp. That is, a diminishing return of input versus output exists in the AC situation. Since the most positive and most negative portions of the sine wave result in the greastest power v, light-output inefficiency, the presently proposed use of unidirectional input having a very small AC component wll eliminate this element of the inefficiency in energy use.

There have existed prior art approaches to the above problems which, in particular, are representatively embodied in such patents as U.S. Pat. No. 2,871,412 (1959) to Lord; U.S. Pat. No. 2,975,333 (1961) to Bird; and U.S. Pat. No. 13,037,147 (1962) to Genuit.

The above patent to Lord requires, in its construction, a special (and expensive) transformer. Also, its primary application appears to be limited to high-pressure arc-discharge devices such as mercury-vapor lamps. In addition, a resonant circuit is utilized to achieve starting. This, it is believed, is a less reliable approach than that set forth in the present invention.

The patent to Bird is, as in Lord, intended primarily for use in high-pressure arc-discharge lamps.

The patent to Genuit, as in the case of Lord, involves the use of a large transformer, known as a saturation transformer, in which the secondary thereof acts as filter choke of the output of the full wave bridge. Further, the primary focus of Genuit appears to be only that of high-pressure arc-discharge devices, as opposed to discharge lamps in general.

DETAILED DESCRIPTION OF THE INVENTION

Figure 1:
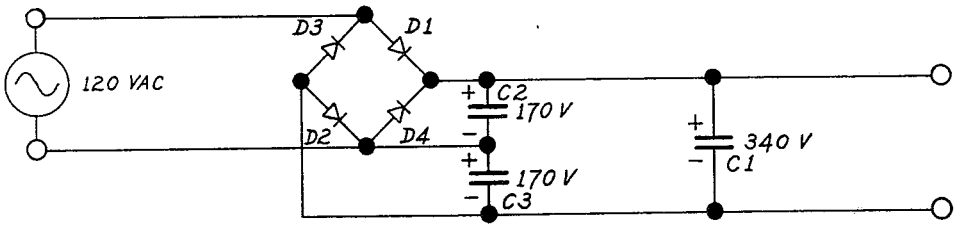
FIG. 1 is a diagrammatic illustration of a full wave bridge in combination with three capacitors.

Illustrated in FIG. 1 is a modified full wave diode rectifier. Further, shown in connection, across the horizontal axis of symmetry of the full wave bridge, is a pair of capacitors C2 and C3, the purpose of which is a voltage-raising means. In FIGS. 4 and 5 and FIGS. 14 and 15, variant configurations are shown.

Figure 2:
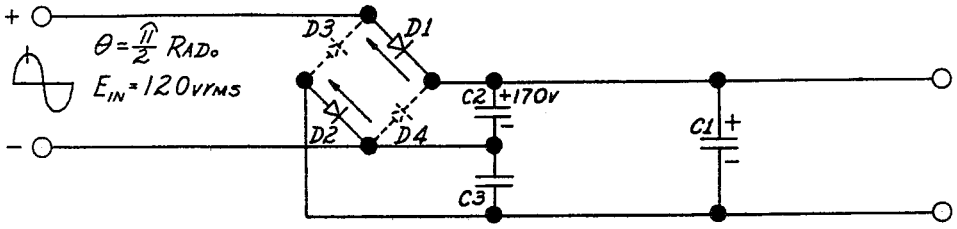
FIG. 2 comprises a further illustration of the subject matter of FIG. 1 indicating, by the arrows, the direction of the instantaneous electron flow at the $\pi/2$ radian point of the input AC sine wave.
Figure 2A:
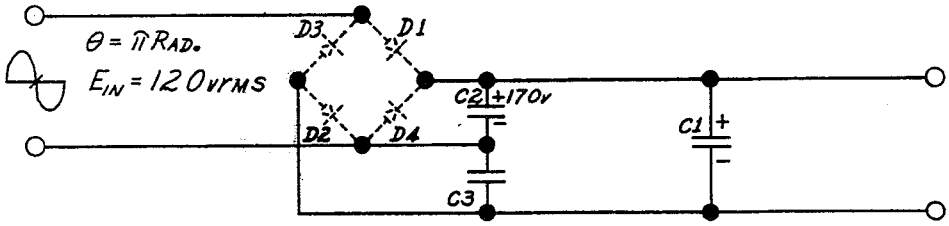
FIG. 2*a* is a further illustration of the subject matter of FIG. 2 in which there is shown the instantaneous condition of the full wave bridge circuit as occurs at the $\pi$ radian point of the input AC sine wave.

FIG. 2 is a schematic illustration showing, in part, the operation of the modified full wave bridge during the positive excursion of the AC input. As can be observed, during the positive excursion, only diodes D1 and D2 conduct, such that capacitors C2 and C3 become charged in the manner indicated in FIG. 2. Therefore, the effective charge shown on the capacitor C1 is obtained. The above is more particularly illustrated in FIGS. 2A and 3 in which the components D1, D2, D3, D4, C2 and C3 constitute a momentary or no-load (prior to the lamp ignition) voltage-doubling circuit. After lamp ignition occurs, the major portion of the lamp current derives from the full wave rectifying action of D1, D2, D3 and D4. Also involved are the storage properties of C1, the smoothing effect of L1, and the operation of the stabilizing components Q1, R2, R3 and R4 (see description of FIGS. 13, 13A and 13B hereinafter). The current limiting or ballasting action is primarily accomplished by the impedence of the input reactive elements, namely, L2 in FIGS. 4, 5, 6, 9 and 12; C5 in FIGS. 7, 11 and 13; T1 in FIGS. 8 and 10; and C2 and C3 in FIGS. 14 and 15. The operation of the above circuits will be described in further detail hereinafter.

With further regard to operation of the voltage-doubler, prior to lamp ignition, a no-load voltage-doubling action occurs as follows: at $\pi/2$ radians in the AC cycle, assuming an input of 120 vac (rms), the voltage across C2 is 170 volts as indicated in FIG. 2. At the same instant of time, the instantaneous voltage across C3 is zero volts; however, there occurs an accumulation of electrons on both plates of C3. Assuming perfect conduction through all diodes, the voltage across the output terminals would equal approximately 170 volts at $\pi/2$ radians in the AC cycle (assuming $E_{in}=120$ vac (rms).

At $\pi$ radians in the AC cycle, the voltage across C2 is 170 volts; the voltage across C3 is zero volts and the voltage across the output terminals remains at $E_{out}=\sqrt{-}2_{in}$ (rms or 170 volts.

Figure 3:
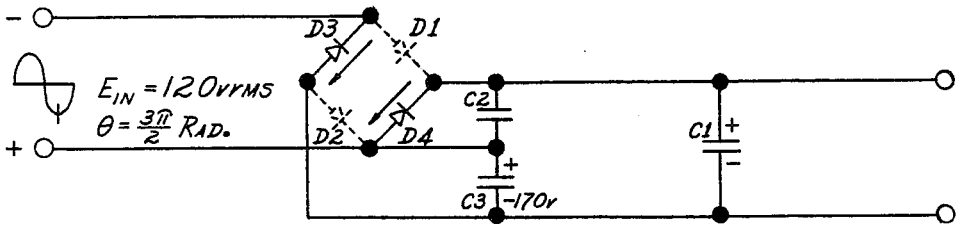
FIG. 3 is a further illustration of the subject matter of FIG. 2 wherein the arrows indicate the direction of instantaneous electron flow at the $3\pi/2$ radian point of the input AC cycle.

With reference to FIG. 3, there is illustrated the manner in which diodes D3 and D4 conduct during the negative excursion of the sine wave where the effective charging across both capacitors C2 and C3 is as indicated by capacitor C1. More particularly, at $3\pi/2$ radians through the AC cycle, the voltages are as is depicted in FIG. 1. It is noted that the voltage across the output terminals is now equal to $E_{out}=2\sqrt{2}E_{in}$ (rms) or 340 volts.

At $2\pi$ radians through the AC cycle, the voltage across the output equals 340 volts (assuming $E_{in}$ (rms)=120 vac).

The positive plate of capacitor C1 becomes in effect an enlargement of the positive plate of C2. The negative plate of C1 becomes in effect an enlargement of the negative plate of C3. The no-load voltage on C1 (prior to lamp conduction) of FIGS. 4 through 15 (later described in appropriate detail) then rapidly rises toward the maximum of $E_{C1}=2\sqrt{2}E_{in}$ (rms) attainable by the voltage-doubler configuration. However, before the maximum voltage is reached, the lamp will begin to conduct and the voltage across the lamp will then stabilize to a value which is determined by the aggregate effect of all circuit components.

In summary, it is seen that through the use of a full wave diode rectifier of the type shown in FIG. 1, in combination with a pair of capactitors, C2 and C3 connected as shown, the capacitor C1 will be charged in such a manner as to provide a voltage of an amplitude equal to twice the peak voltage (of the half cycle) of the input.

Figure 4:
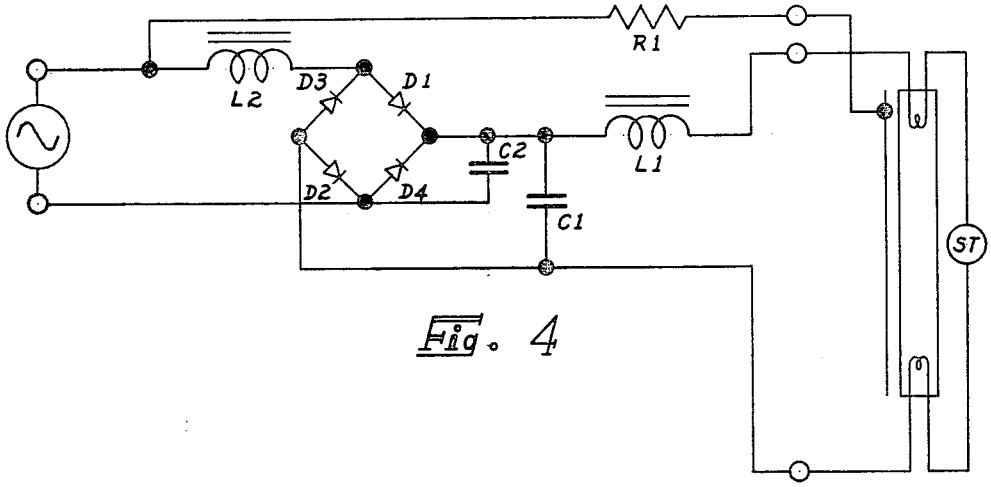
FIG. 4 illustrates the basic circuit of the present invention utilizing a full wave diode bridge in combination with a current limiting inductor L2, a filtering capacitor C1, and a filtering inductor L1.

With reference to the circuit of FIG. 4, prior to conduction across the lamp, capacitor C1 charges to approximately the peak voltage of the line by virtue of the rectifying action of the full-wave bridge (D1, D2, D3 and D4) that is $E_{max}=\sqrt{2}$ E line-rms which is approximately 170 volts. As charging occurs, the capacitor C2, which is disposed in parallel with diode D4, acts as half-wave voltage doubler in conjunction with the full-wave bridge, and begins to charge capacitor C1 to the theoretical maximum of a doubler circuit which is $E_{max}=2\sqrt{2}E$ line-rms or about 340 volts.

However, before C1 can become fully charged to maximum value, conduction across the lamp will initiate. Further, since C2 is relatively small with respect to the amount of current drawn by the lamp, the voltage across C1 will fall rapidly to a level which is slightly above the voltage normally provided by the full-wave rectifier. Coincidental with the reduction in the voltage of C1, the current through the inductor L2 will increase to a normal design value, resulting in an increased inductive reactance within L2. This continues until said reactance reaches its design value in accordance with the formula $X_L=2\pi fL$. This function of the inductor L2 creates the well-known current-limiting or ballasting action required by discharge lamps. This ballasting action effectively reduces the input voltage to the bridge rectifier, thus reducing the voltage across C1 to the extent that the resulting current through the lamp will be limited to a value which will not cause a premature burn-out of the lamp.

L1 is a filter choke, the function of which is to provide an impedance against the $2f$ pulses which appear at C1 as a result of the input from the full-wave rectifier. Resistor R1 is a high value current-limiting resistor which serves as safety device, in the event that the circuit is inadvertently connected incorrectly to the line.

Figure 5:
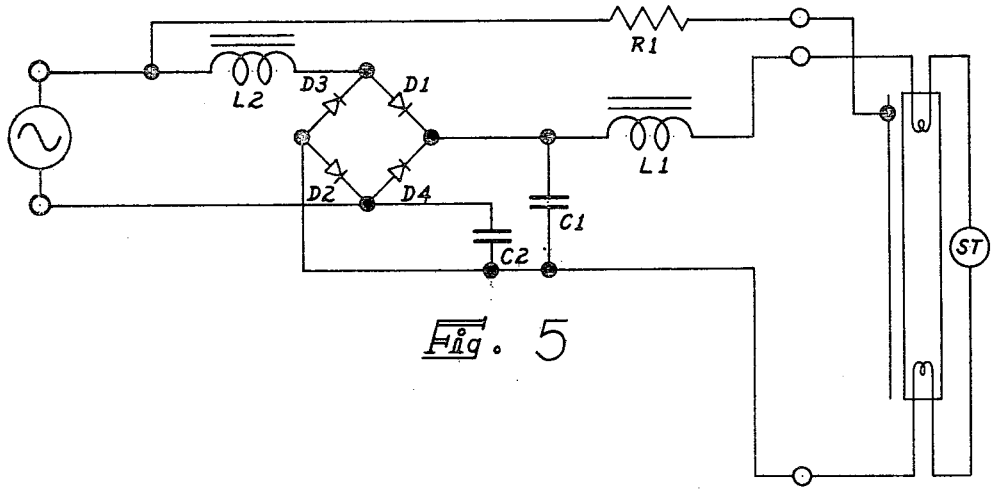
FIG. 5 illustrates a second embodiment of the present invention wherein the capacitor C2 has been repositioned with respect to the diode bridge.

The circuit of FIG. 5 functions as does the circuit of FIG. 4, however, the capacitor C2 is connected in parallel with D2.

It is noted that in parallel with the lamp is a starter ST. The starter may be a standard gas-filled bi-metal spring type, or any other such starter. While most lamps, operating with the current described herein, will generally conduct without a starter, the use of a starter improves the life of the lamp filaments.

Figure 6:
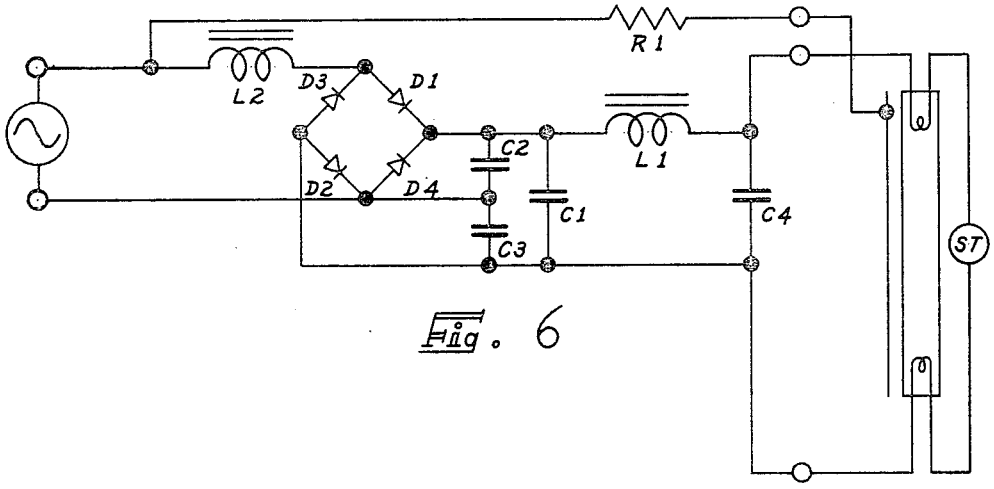
FIG. 6 represents a third embodiment of the present invention exhibiting the use of two capacitors across the diode bridge.

FIG. 6 is similar to FIGS. 4 and 5 except that both capacitors C2 and C3, as shown and described in FIG. 1, are utilized.

It is noted that said capacitors C2 and C3 now function as a full-wave voltage doubler, thereby raising the voltage on C1 more quickly and providing a smoother current flow to C1, wherein the ripple frequency is equal to 2f (a more desirable situation) as opposed to the ripple frequency which would exist if only one capacitor were used. (The frequency due to the half-wave voltage doubler would be of a lower and therefore coarser frequency). C4 is a radio frequency suppression capacitor which serves to prevent the circuit from oscillating at some radio frequency. Capacitor C4 is utilized in the embodiments of FIGS. 6 through 15.

It is to be noted that in the embodiments of FIG. 4 through 8, and FIG. 14, the starter unit ST, shown in series with the lamp filaments, performs a conventional momentary filament-heating function.

Figure 7:
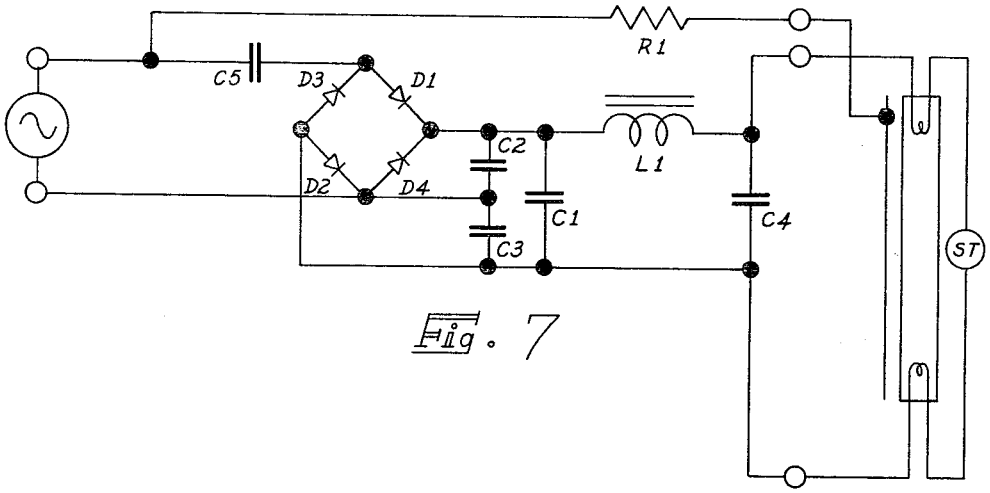
FIG. 7 is similar to the schematic of FIG. 6, showing a substitution of capacitor C5 for inductor L2.

FIG. 7 is similar to FIG. 6 except that a capacitor C5 has been substituted for the inductor L2. This substitution, it has been found, results in greater economy of operation inasmuch as the dielectric losses of the cpacitor C5 are neglible compared to the resistive and hysteresis losses existent in the use of an inductor such as L2. Thusly, the power consumption of the circuit of FIG. 7 would be only slightly greater than the actual power consumed by the lamp, per se.

Figure 8:
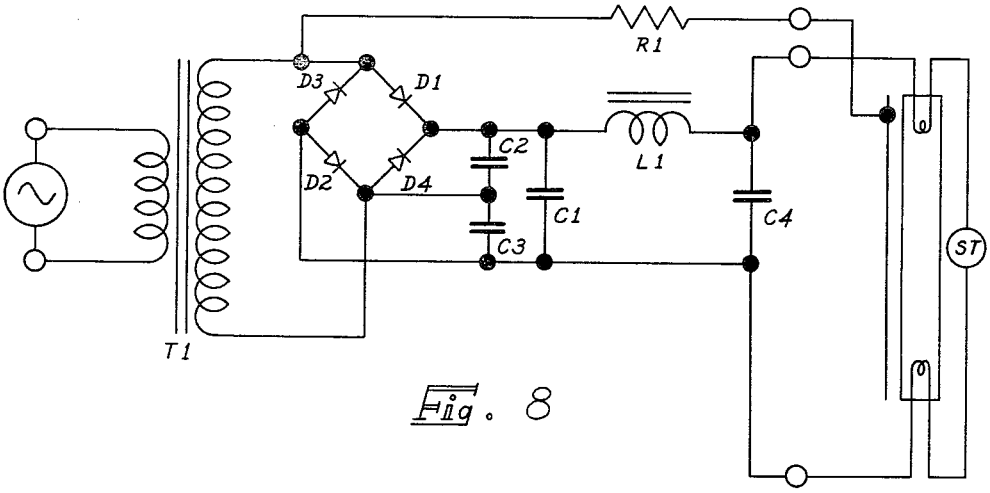
FIG.8 is a schematic illustration, similar to that in FIG. 6, in which a step-up transformer has been utilized in order to provide a higher start-up voltage across the diode bridge.

The embodiment of FIG. 8 provides for an input through a step-up transformer T1 which, in addition to providing a higher starting voltage, also provides the ballasting action for the lamp, thus eliminating the need for inductor L2. The circuit of FIG. 8 has particular applicability to longer lamps which generally require higher starting voltages.

Figure 9:
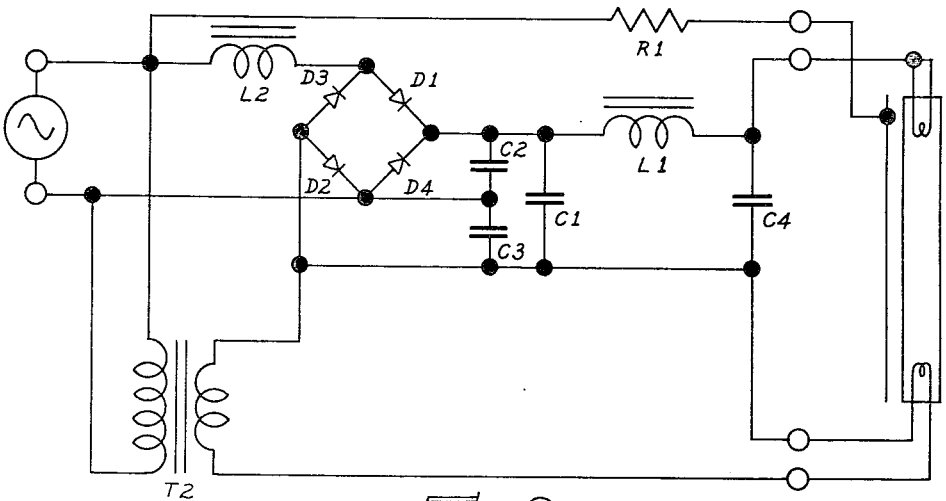
FIG. 9 is a schematic similar to that of FIG. 6 except that the starter-unit has been removed and a filament transformer T2 has been added.

In the embodiment of FIG. 9, the starter unit ST has been removed and a filament transformer T2 has been added. The addition of T2 provides rapid start capability and, thusly, can be connected so as to cause the filament to be pre-heated thereby, in the case of fluorescent lamp circuits, obtaining an instant-start capability.

Figure 10:
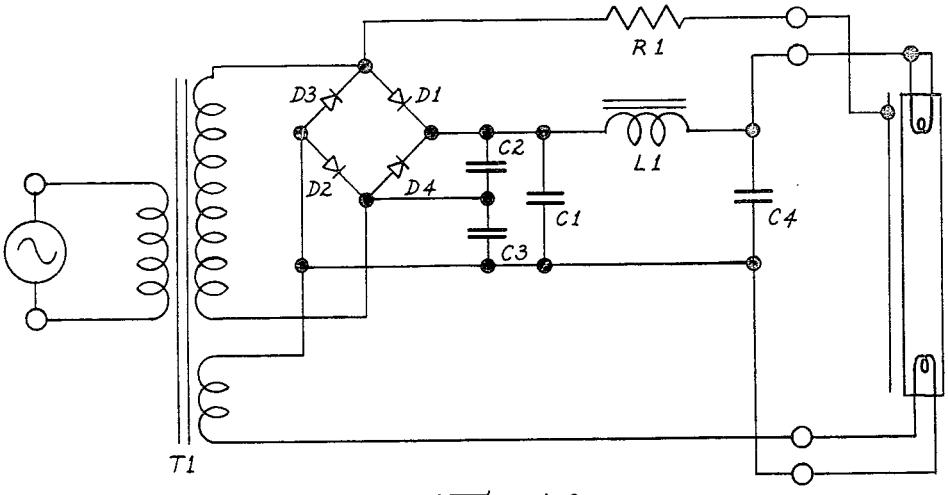
FIG. 10 is a view similar to FIG. 8 with the exception that a filament heater winding has been added to the step-up transformer.

The embodiment of FIG. 10 is generally similar to FIG. 8 except that a filment heater winding has been added to T1 and that the starter unit has been eliminated. This configuration provides the increased starting voltage required for longer lamps, plus the rapid- or instant-start capability mentioned above with respect to the embodiment of FIG. 9.

Figure 11:
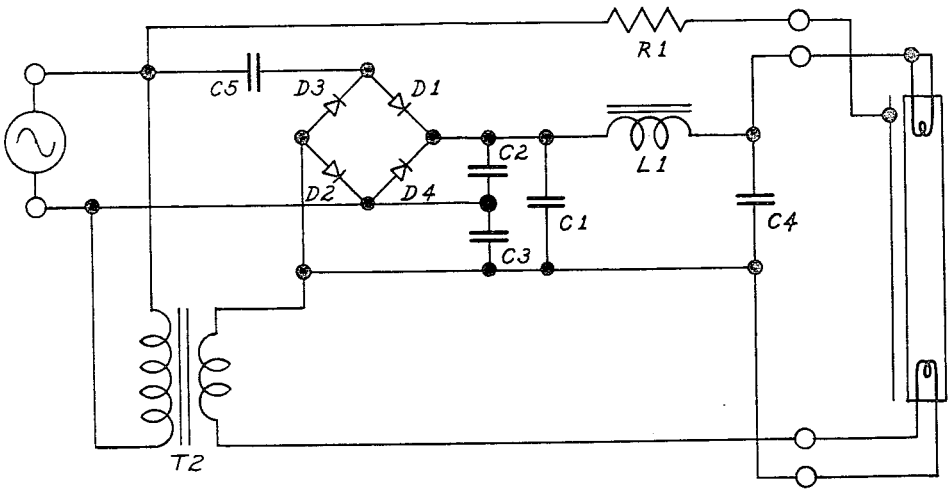
FIG. 11 is an embodiment incorporating design advantages of the embodiments of FIGS. 7 and 9.

FIG. 11 combines the economical operation attendant to the use of the capacitor C5 (see description per FIG. 7 above) in addition to the rapid- or instant-start capability above-discussed with respect to the embodiment of FIG. 9.

Figure 12:
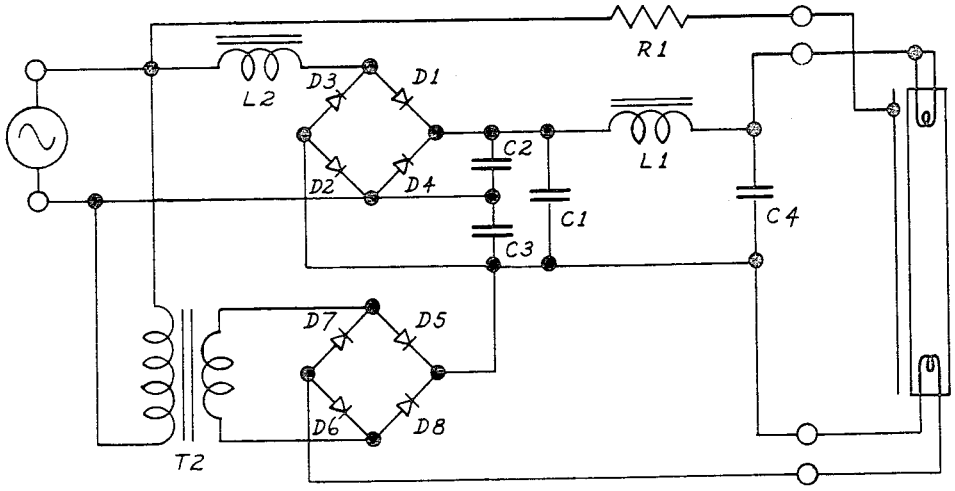
FIG. 12 illustrates an embodiment similar to that of FIG. 9 with the exception that a full-wave diode bridge has been added to the output of the filament transformer T2.

The embodiment of FIG. 12 utilizes two full-wave bridges, the second of which is a bridge rectifier placed within the filament heating circuit. The advantage of such a bridge is that the normal 60 Hertz waveform produced by the filament transformer T2 is rectified into 120 Hertz pulses which, due to the filtering components in the lamp supply, are out of phase and thus tend to cancel the effect of the small amount of 2f ripple in the lamp supply. The advantages of this configuration include flickerless operation of exceptional optical quietness due to the reduced effect of the small amount of alternating current component at 2f which remains in the lamp current. Further, the configuration of FIG. 12 possesses the above-described rapid- or instant-start capability when applied to fluorescent lamps.

Figure 13:
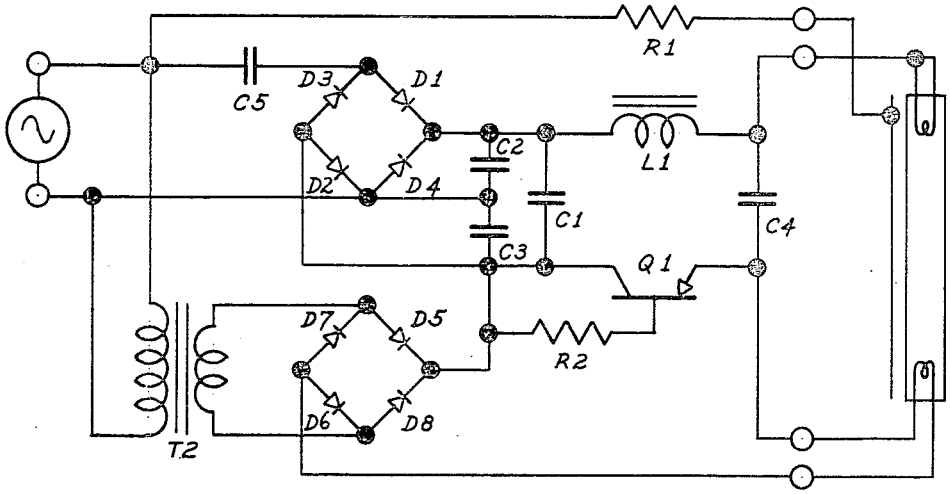
FIG. 13 is similar to FIG. 12, however showing a substitution of L2 by C5 for the purpose of greater operating economy and the addition of a stabilizing circuit consisting of Q1 an R2.
Figure 13A:
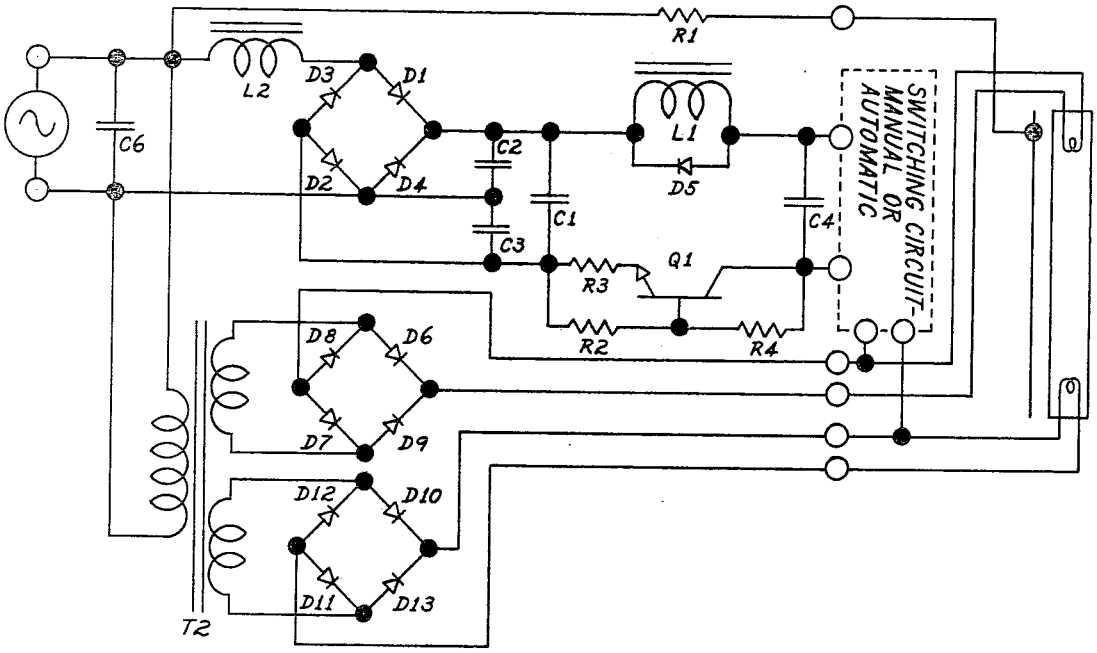
FIGS. 13A and 13B comprise improvements of the embodiment of FIG. 13 wherein switching circuits are employed, and additional components have been added to the Q1 stabilizing circuit.
Figure 13B:
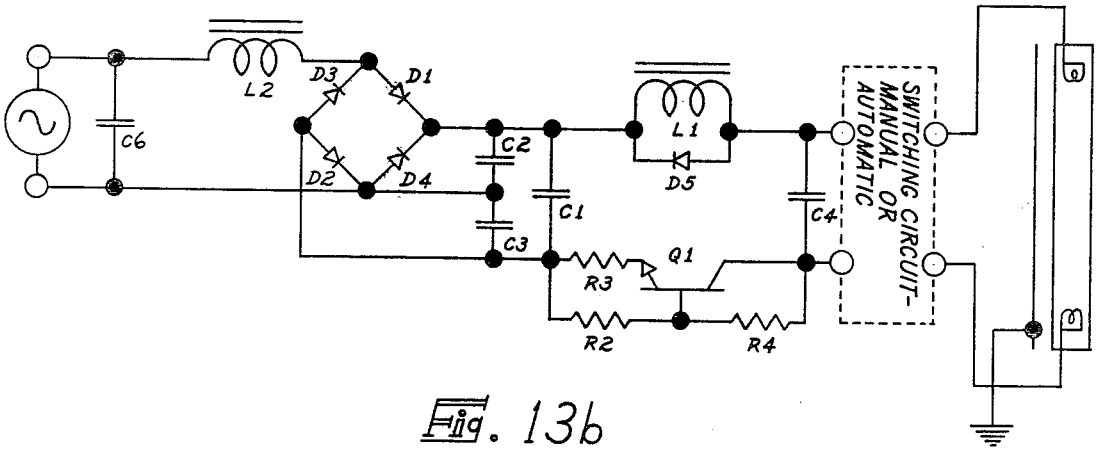

FIG. 13 is similar to the circuit of FIG. 12 with the exceptions that: (a) C5 is substituted for L2 thereby providing all of the advantages of FIG. 12 plus the added economy of operation attendant to the use of capacitor C5 (refer to the description of FIG. 7 above) and (b) the stabilizing circuit consisiting of Q1 -R2 has been added. The stabilizing circuit is designated in such a manner as to exhibit non-linear impedance characteristics which are in opposition to the non-linear characeristics of the lamp. This opposition provides more linear impedance characteristics to the over-all circuit—the result of which is stable current charcteristics which eliminates the tendency of a discharge lamp operating on uni-directional current to function as a relaxation oscillator (resulting in optical "flutter") at low lamp-current levels. This added stability makes possible a selection of input impedances at C5, thereby making a variety of brightness levels available. The stabilizing circuit (Q1–R2) can be utilized with any of the herein described circuits. FIGS. 13*a* and 13*b* illustrate improvements of FIG. 13, having the following modifications of FIG. 13: L2 in place of C5; D5 across L1, the purpose of which is to suppress oscillations within L1 during lamp-current reversal; the addition of resistors R3 and R4 in the stabilizing circuit of Q1—the purpose of which is to allow the stabilizing circuit (Q1, R2, R3 and R4) to more efficiently oppose an increase in lamp-current. Both FIGS. 13*a* and 13*b* depict the addition of a lamp-current reversing circuit, as previously discussed. FIG. 13*a* shows full-wave rectification of both lamp-filament supplies—which is desirable in circuits utilizing a lamp-current reversing circuit and where continuous pre-heating of the lamp-filments occurs.

FIG. 13*b* does not incorporate filament-heating circuits, and would be used with single-pin type fluorescent lamps. Capacitor C6 is illustrated to show proper placement in order to eliminate R-F disturbances from being fed back into the AC supply lines.

Figure 14:
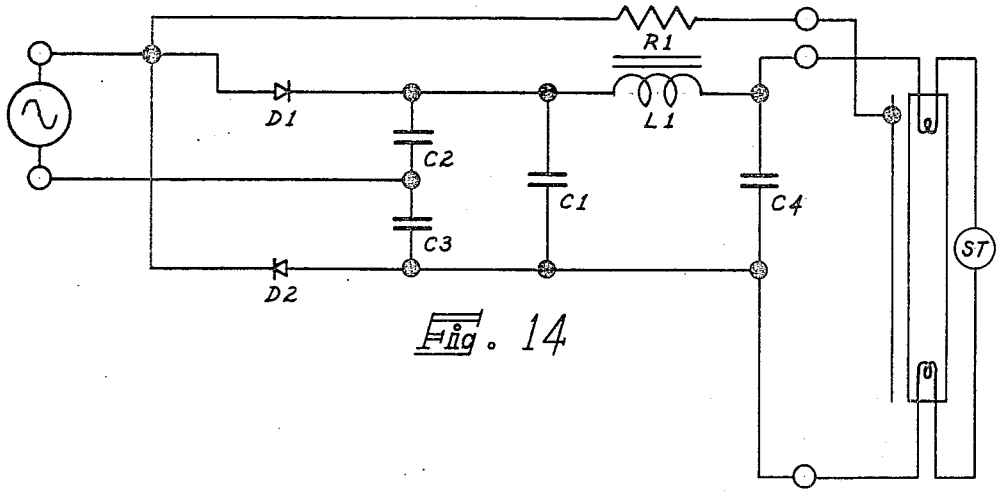
FIG. 14 is an embodiment which also accomplishes the goals set forth in the Summary of the Invention and illustrates that said goals can be accomplished by utilizing a variety of circuit configurations.

FIG. 14 represents an embodiment which, although somewhat different from the previous circuits, accomplishes all of the goals set forth in the Summary of the Invention. At the input is voltage-doubler (D1, D2, C2 and C3) which, as in the preceeding circuits, begins to charge C1 to $E_{max}=2\sqrt{2}$ E line-rms. Before this voltage can be achieved, however, the starter-unit closes the filament circuit in the usual manner. As the starter-unit then breaks the filament circuit, C1 again begins to charge to the theoretical maximum provided by the voltage-doubler input. Again, before the maximum voltage can be attained, the lamp conducts, facilitated by thermionic emission from the negative filament.

The configuration of this circuit also provides the considerable economy of operation attendant to a capacitive input (refer to the description of FIG. 7 above).

Figure 15:
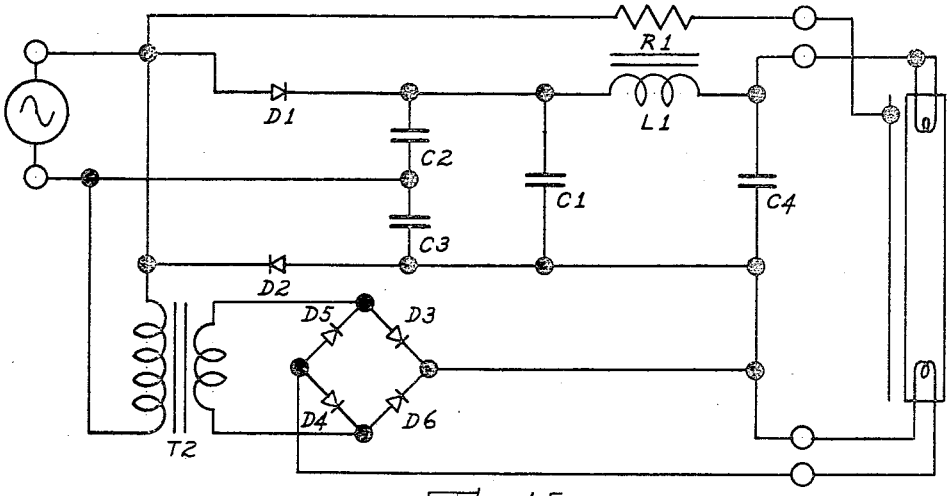
FIG. 15 is a circuit which is basically similar to that of FIG. 14 with the exceptions that the starter-unit has been eliminated, and a filament transformer T2 has been added which utilizes a full-wave diode rectifier to accomplish heating of the negative filament.

FIG. 15 is an embodiment which incorporates the advantages of the above FIG. 14, with the additional instant-start or rapid-start advantages of the filament circuitry of FIG. 12.

In has been found that in order to operate a discharge lamp on unidirectional current, it is necessary to incorporate a switching circuit, such that the lamp current will flow for approximately an equal amount of time in each direction through the lamp. The reasons necessitating such reversal of the direction of the lamp current are: to provide equal wear upon each lamp electrode; to prevent migration of phosphor coating within the lamp; and to prevent the accumulation of a lamp envelope inner surface charge (negative) at the anode end—the direct result of which would be a reduction of the light output from the lamp.

Also, it has been founnd that there is a time period requirement for lamp current switching. In particular, the time period within which the lamp current must be reversed is not dependent upon either the problem of obtaining equal wear on each lamp electrode or upon the phosphor migration problem. Rather, it is primarily dependent upon the problem of accumulation of negative charge on the lamp envelope inner surface at the anode end thereof, resulting thereby in a reduction in the light output of the lamp. In other words, the amount of time in which the lamp unit may be operated, with the lamp current flowing in one direction, will be limited so as to prevent charge accumulation such as would otherwise detract from the total light output of the lamp.

It has, in general, been found that the amount of charge accumulation resultant from a undirectional current is dependent upon the velocity of the electrons and negative ions within the lamp and upon the amount of current flow (density of electrons and negative ions) within the lamp.

The velocity of the charged electrons and ions is, in turn, primarily dependent upon the discharge length of the lamp, (this determining the time period during which the negatively charged particles are accelerated), and accelerating voltage (operating voltage) of the lamp.

Approaching the switching circuit problem, it has been determined that several types of switching circuits can be used with the herein disclosed flickerless lamp circuits. These include manual switching which has particular applicability to portable lamp units having discharge-length lamp-current parameters which do not necessitate periodic lamp-current reversing during the lamp unit duty cycle, and having the power-switch as an integral part of the lamp unit. The switch can comprise a double-pole double-throw current reversing means incorporated into the power switch, such that each time the power switch is manually actuated, the current reversing switch will be simultaneously actuated.

It has also been determined that an automatic remote switching unit may be employed for lamp units having discharge-length and lamp-current parameters which do not necessitate periodic switching during the duty cycle of the lamp unit. For this type of lamp circuit (which requires lamp-current switching only at the beginning of the duty cycle), a continuous-duty double-pole double-throw latching relay can be employed. This arrangement would cause the lamp to automatically reverse each time the lamp unit is energized. However, the disadvantage of said arrangement is that the latching relay would continually draw a certain amount of power, although small, during the total duty cycle of the lamp unit. Therefore, use of such a latching relay would detract from the power and cost efficiency of the lamp unit. It has been found that the above set forth disadvantage can be overcome by activting said latching relay with a pulse circuit which would draw only momentary power at the beginning of each lamp unit duty cycle.

A further approach to the switching problem is the use of an automatic periodic switching means for use with lamp units having discharge-length and lamp-current parameters which necessitate periodic lamp-current reversals during the lamp unit duty cycle. For this type of lamp circuit, there are two types of switching circuits that can be utilized, namely, a latching relay which is driven by an electronic timing circuit; or an all solid-state switching circuit which is driven by an electronic timing circuit.

For multiple lamp fixtures (requiring multiple ballasts), having discharge-length and lamp-current parameters which necessitate periodic lamp-current reversal during the lamp unit duty cycle, a switching module can be utilized which incorporates sufficient switching capability for all the lamps within said fixture. This type of switching module could be serviced as a unit, separate from the ballasts within said fixture and, accordingly, this would serve to reduce manufacturing costs.

In view of the foregoing, it can be appreciated that, in order for a flickerless circuit to function properly, it is necessary to design a switching circuit which will take into full consideration all design and use parameters. Examples of such design appears in FIGS. 13*a* and 13*b* described above.

While there have been herein shown and described the preferred embodiments of the present invention, it will be understood that the invention may be embodied otherwise than as herein specifically illustrated or described and that within said embodiments, certain changes in the detail and construction, and the form of arrangement of the parts may be made without departing from the underlying idea or principles of this invention within the scope of the appended claims.

Having thus described my invention, what I claim as new, useful and non-obvious and accordingly secure by Letters Patent of the United States is:

1. A circuit for improving the efficiency of energy consumption, extending lamp life, and facilitating the starting and steady-state flickerless operation of a discharge lamp normally utilizing a source of alternating current, comprising:

(a) a full-wave rectifier connected between both an input set of terminials and an output set of terminals, said input set of terminals comprising the AC line current supply and the output set of terminals comprising the positive and negative leads of the lamp;

(b) voltage-raising capacitance means disposed across the output of said rectifier;

(c) ballast means disposed between said AC line current supply and said rectifier whereby a substantial portion of the current provided by said circuit passes through said ballast means (d) filtering capacitor means cooperating with said ballast means connected between the positive and negative output of said full-wave rectifier, wherein the output of said voltage-raising capacitance is applied across said filtering capacitor, thereby providing a no-load voltage across said filtering capacitor means approximately equal to twice the peak input line voltage, said circuit comprising further a non-linear impedance stabilizing circuit coupled between said rectifier and said lamp having non-linearity characteristics opposing those of the discharge lamp for operating said lamp free of flicker by smoothing ripple in current through said lamp.

2. The circuit as recited in claim 1 in which said voltage-raising capacitance comprises two capacitors, one of said capacitors connected between said AC input to the positive rectifier output, and the other capacitor connected between said AC input and the negative rectifier output.

3. The circuit as recited in claim 1 in which said full-wave rectifier comprises a full-wave diode rectifier.

4. The circuit as recited in claim 1 in which said circuit further comprises:

a filter inductor, connected in series between the positive output of said rectifier and the positive lamp electrode.

5. The circuit as recited in claim 1 in which said circuit further comprises:

a step-down transformer, the primary of which is placed across the AC input, the secondary of which is placed across the input of the negative electrode filament of the lamp, whereby through the use of said step-down transformer, continuous heating of the negative electrode is obtained, thereby obtaining an enhanced start-up of the lamp.

6. The circuit as recited in claim 1 in which said circuit further comprises:

a step-up transformer disposed between the AC input of the input to the full-wave rectifier, including a step-down winding which is placed across the input to the negative electrode.

7. The circuit as recited in claim 6 in which said circuit further comprises a second full-wave rectifier, said second rectifier placed within the secondary of said stepdown transformer, and the output of said second rectifier placed across the terminals of the negative electrode.

8. The circuit as recited in claim 4 having a non-linear impedence connected in series with one electrode of the lamp.

9. The circuit as recited in claim 4 in which said circuit also includes a radio frequency suppression capacitor disposed across the filament leads.

10. The circuit as recited in claim 1 in which said circuit further comprises:

a non-linear impedance stabilizing switching circuit connected across the respective input leads of the lamp, whereby undesirable accumulation of negative charge at the anode side of the lamp is avoided.

11. A circuit for improving the efficiency of energy consumption, extending lamp life, and facilitating the starting and steady-state flickerless operation of a discharge lamp normally utilizing a source of alternating current, comprising:

(a) a full-wave rectifier connected between both an input set of terminals and an output set of terminals, said input set of terminals comprising the AC line current supply and the output set of terminals comprising the positive and negative leads of the lamp;

(b) voltage-raising capacitance means disposed cross the output of said rectifier;

(c) ballast means disposed between said AC line current supply and said rectifier whereby a substantial portion of current provided by said circuit passes through said ballast means; and (d) filtering capacitor means for smoothing the flow of current from said circuit by cooperting with said ballast means said filtering capacitor connected between the positive and negative output of said full-wave rectifier, wherein the output of said voltage-raising capacitance is applied across said filtering capacitor, thereby providing a no-load voltage across said filtering capacitor means approximately equal to twice the peak input line voltage.

* * * * *